US005417926A

United States Patent [19]

Bouveret

[11] Patent Number: 5,417,926

[45] Date of Patent: May 23, 1995

[54] DEVICE FOR THE SUPPORT AND PROTECTION OF A MICROPIPETTE

[75] Inventor: Patrick Bouveret, Neuilly en Thelle, France

[73] Assignee: Laboratoire C.C.D., Paris, France

[21] Appl. No.: 282,455

[22] Filed: Jul. 29, 1994

[30] Foreign Application Priority Data

Aug. 20, 1993 [FR] France ..... 93 10141

[51] Int. Cl.[6] ..... B01L 9/00

[52] U.S. Cl. ..... 422/104; 211/60.1; 248/316.17; 24/557; 206/364

[58] Field of Search ..... 422/104; 211/60.1; 248/316.17, 231.8; 24/557, 565; 206/305, 364, 380, 379

[56] References Cited

U.S. PATENT DOCUMENTS

| | | | |
|---|---|---|---|
| 2,215,118 | 9/1940 | Flood | 206/65 |
| 2,551,012 | 5/1951 | Kenah | 211/60.1 |
| 2,591,477 | 4/1952 | Tegarty | 24/557 |
| 2,598,492 | 5/1952 | Boes | 206/43 |
| 2,651,407 | 9/1953 | Blackman | 206/43 |
| 3,010,569 | 11/1961 | Goldman | 206/16.5 |
| 3,176,504 | 4/1965 | Shapiro | 211/60.1 |
| 3,453,700 | 7/1969 | Petertel et al. | 24/557 |
| 3,525,264 | 8/1970 | Niegeus et al. | 422/104 |
| 3,834,876 | 9/1974 | Körmendy et al. | 422/104 |
| 3,918,920 | 11/1975 | Barber | 422/104 |
| 4,963,326 | 10/1990 | Eberle | 422/101 |
| 5,139,746 | 8/1992 | Rabenecker | 422/104 |

FOREIGN PATENT DOCUMENTS 289574 5/1928 United Kingdom .

*Primary Examiner*—James C. Housel
*Assistant Examiner*—N. Bhat
*Attorney, Agent, or Firm*—Young & Thompson

[57] ABSTRACT

A device for the support and protection (1) of a tubular element (2) of very small diameter, particularly of the type of a micropipette, comprising a portion of constant nominal diameter and a drawn out end (3) . The device is a monobloc member, of a material having elasticity, such as a resilient plastic, comprising an elongated body (4) whose dimension in its longitudinal direction is at least equal to the length of the tubular element (2) to be supported and whose transverse cross section has the shape of an inverted U with a base (5) prolonged by two legs (6, 7) , the base f the U comprising on its flat external surface, at least two recesses (9, 10) opening outwardly, disposed in prolongation of each other and being separated by a distance less than the length of the tubular element, so as to receive this latter and to retain it in two spaced regions. Each of these recesses is delimited by two parallel edges (11, 2) extending from the base of the U.

5 Claims, 1 Drawing Sheet

FIG. 1
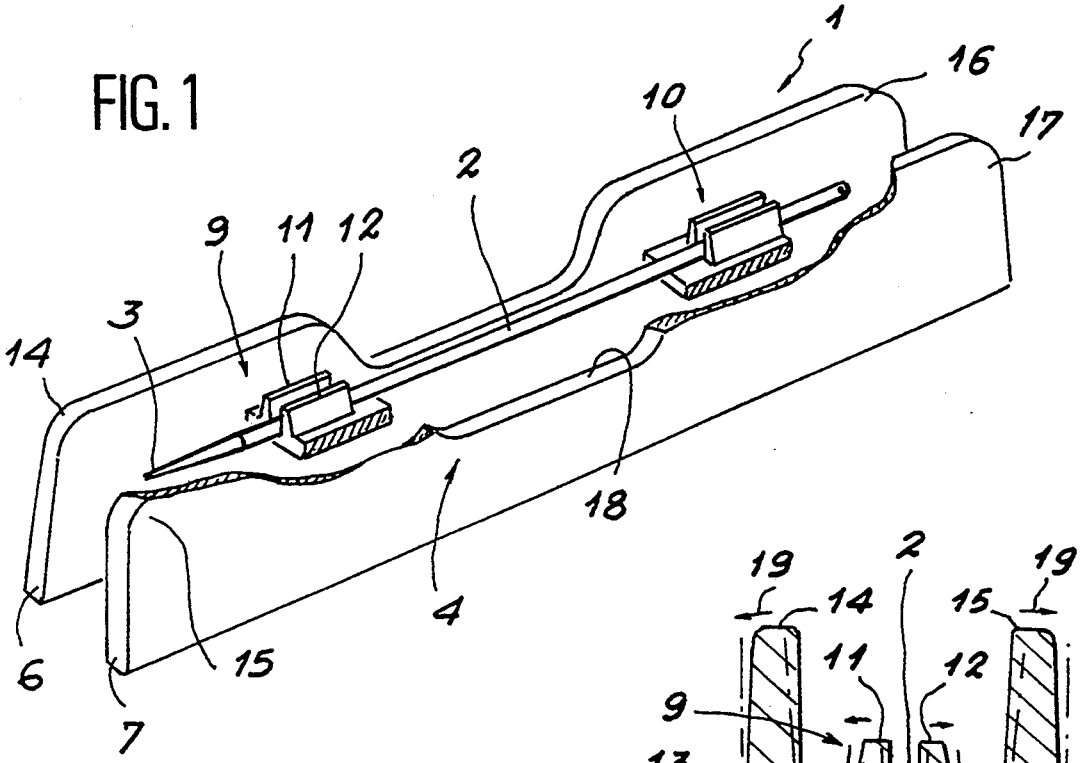
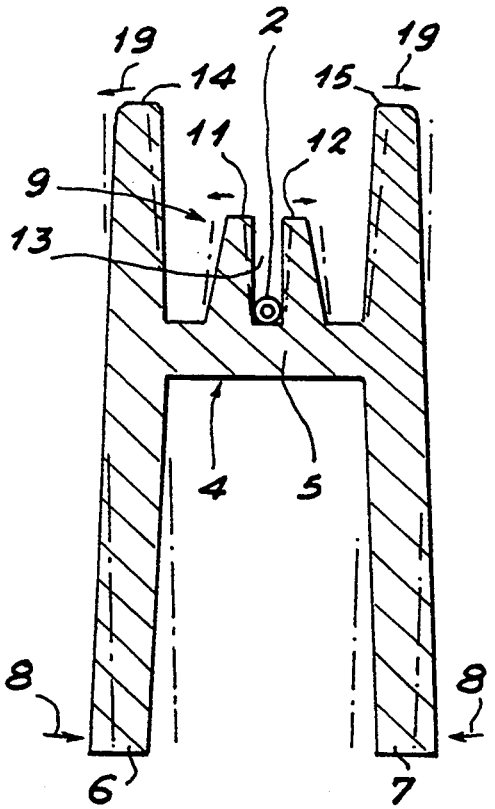
FIG. 2
FIG. 3
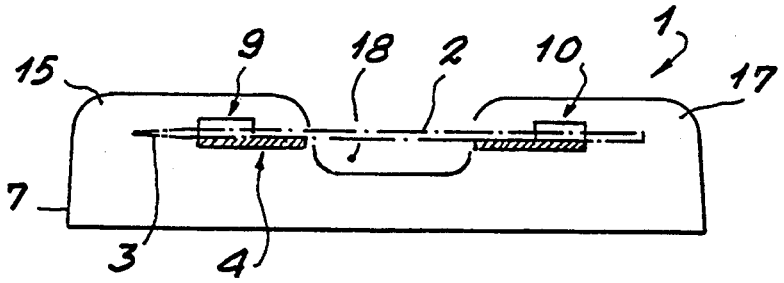

DEVICE FOR THE SUPPORT AND PROTECTION OF A MICROPIPETTE

The present invention relates to a device permitting ensuring the support and manipulation, particularly for its transfer or storage, of a tubular element generally of glass or a similar material, of very small external diameter for example of 1 mm or less, and whose length is very much greater, as the case may be about 10 cm or more, namely in a ratio of the order of 100 with the diameter, which renders this element particularly fragile and prevents its gripping and use without taking extreme precautions.

The invention is applicable more particularly, but not exclusively, to a support device adapted to receive and to protect a micropipette for medical applications, in the form of a glass tube whose nominal dimensions correspond substantially to those cited above, this tube being moreover drawn out at one of its ends to provide an extension in which its internal diameter is reduced to a value of several microns, namely approximately a dimension 100,000 times less than that of the length of the tube and of the order of 1,000 relative to its external diameter, in the main portion of the latter. Such very fine tubes are particularly used in in vitro fertilization techniques to permit the injection of one or several spermatozoids removed and collected in a tube of this type in its thin end, in an ovocyte provided to receive them, also maintained by means of an analogous tube.

It will therefore be understood that it is indispensable that such tubular elements may be manipulated with the greatest care, not only during the operations associated with their use, but more generally continuously, when they are to be transported or stored.

The present invention has for its object a support device which permits assuming these functions under maximum safety conditions, by protecting the tubular element against shocks and flexure, even the slightest, which would unmendably break them, which will be easy to grasp and to move by the user, which is easy to use when the tubular element is to be positioned or withdrawn, which will be of low cost requiring negligible maintenance and finally having only a small size.

To this end, the support device in question is characterized in that it is constituted by a monobloc member, of a material having a relative elasticity, comprising an elongated body whose dimension in its longitudinal direction is at least equal to the length of the tubular element to be supported and whose cross section on a plane perpendicular to this longitudinal direction is substantially of an inverted U-shape with a central base prolonged by two side legs substantially parallel to each other, the base of the U comprising on its external surface, which is preferably flat, at least two recesses opening outwardly, made at the same time as the support body, disposed in prolongation of each other and being separated by a distance less than the length of the tubular element, so as to receive this latter while supporting it in two suitably spaced regions, each of these recesses being delimited by two parallel edges extending from the base of the U, approximately perpendicular to the latter and parallel to the longitudinal direction of the body.

Thanks to the elasticity of the material constituting the body of the monobloc support, simple pressure on the end of the two lateral legs of the inverted U to bring them toward each other by making them pivot slightly relative to the base which connects them, simultaneously gives rise to a reverse opening force of the two recesses in the manner of scissors, the edges of these recesses mutually spacing themselves apart and permitting the safe and risk-free introduction of the tubular element onto the support within these recesses.

Relaxing the pressure on the lateral legs then brings the two edges of the previously spaced recesses into their initial position, the tubular element being then suitably locked between these edges forming a grip, with a force which depends on the relative dimensions of the external diameter of the tubular element and of the spacing of these edges, determined by its construction, whose spacing is just enough to ensure the maintenance of the tubular element in place without risk of crushing or deleterious twisting.

Conversely, prior to use of the tubular element, a fresh force exerted on the lateral legs of the body spreads the edges of the recesses, permitting gripping and replacing the element on its support with the ordinary precautions, for its transportation or ultimate storage.

Preferably, the material constituting the support body is a plastic material, of the type of polyethylene, polyvinyl chloride or the like, particularly and still more preferred, of polypropylene.

According to a particular characteristic of the support in question, the sides of the base of the U, in line with its lateral legs, comprise facing the recesses and spaced from the edges of these latter, extensions prolonging these legs to improve the protection of the tubular element disposed in these recesses.

Preferably, the height of the extensions is substantially greater than that of the edges of the recesses.

According to still another characteristic, the monobloc support body has in its central region, between the two recesses receiving the tubular element, a large notch provided in its lateral legs, between the extensions prolonging these latter, through which the base of the U is eliminated so as to disengage the element within the notch, so as to permit during extraction or emplacement of this element in its recesses, gripping it more easily by its middle, without special measures and particularly without touching its most fragile lengthened end.

Other characteristics of support and protection device for a tubular element for withdrawing having a very small nominal external diameter and preferably a drawn out end, will appear from the description which follows of an example of an embodiment given by way of indication and not in a limiting sense, with reference to the accompanying drawing, in which:

BRIEF DESCRIPTION OF THE DRAWINGS

FIG. 1 is a perspective view of the support in question, shown provided with a tubular element carried by this support;

FIG. 2 is an elevational view of the support of FIG. 1;

FIG. 3 is a transverse cross sectional view on a larger scale of the support of FIG. 2, in a plane perpendicular to its longitudinal direction, in line with one of its support recesses in which is mounted the tubular element.

As will be seen in these figures, the support in question, designated in general with reference 1, is adapted to ensure the support and maintenance of a tubular element 2, particularly for transportation or storage of this latter.

Preferably, the element 2 is constituted by a hollow glass tube of very small external diameter, of the order of 1 mm, although the effective size of this diameter is by itself a matter of indifference to the invention, the support being adaptable, as indicated above, to tubes of diameters which can be different. This element has a length much greater than its diameter, for example of the order of 9 to 10 cm, in the example more particularly considered.

Moreover, and within the scope of the use of such a tube more particularly envisaged, in which the tubular element is adapted to constitute a micropipette for use in in vitro fertilization techniques, this element 2 comprises at one of its ends a drawn-out portion 3 whose diameter is very much reduced, the internal conduit in this portion of the tubular element being brought to about several microns.

The support according to the invention permits ensuring efficacious protection of such a micropipette which it will be understood is extremely fragile with respect to any shock or flexure, not only in its drawn-out end, but also in its main portion in which the ratio of the length of the tube to its diameter is about 100 for the given dimensions.

To this end, the support 1 is comprised by a monobloc body 4 of elongated shape whose length is substantially greater than that of the tubular element 2 and of its drawn-out end 3, such that this element does not exceed the apparent contour of the body 4 when it is carried by this latter.

As will be seen more particularly in the cross sectional view on a larger scale of FIG. 3, the body 4 has, as its cross section, an inverted U-shaped profile with a central or base portion 5 extending substantially horizontally to the upper portion of the body and two lateral legs 6 and 7, parallel to each other and extending substantially vertically from the base 5.

The body 4 is of a relatively rigid material but nevertheless has a certain elasticity, so as to permit limited movement toward each other of the lateral legs 6 and 7 when the user exerts on these latter a force to bring them together, particularly between the thumb and the index finger, this movement toward each other being schematically shown on the drawing by the opposite arrows 8 at the lower portion of the legs 6 and 7.

The body 4 moreover comprises, on the upper surface of the base 5, two recesses respectively designated by reference numerals 9 and 10 in FIGS. 1 and 2, these recesses, opening outwardly, being adapted to receive the tubular element 2 thereby permitting retaining this latter at two regions separated from each other along the length of this element within the body 4.

These recesses 9 and 10 are disposed in prolongation of each other, substantially in the medial plane of the support, each of them being constituted by two edges, respectively 11 and 12 (FIG. 3), extending parallel to each other and perpendicular to the base 5 of the body 4 so as to delimit between them a space 13 for emplacement in this latter of the corresponding portion of the element 2.

Of course the width of the space 13 between the parallel edges 11 and 12 of each of the recesses 9 and 10 is determined by the construction such that, when the tubular element 2 is engaged in these recesses, it will be suitably immobilized without however being subjected to excessive pressure which would give rise to breaking it, given its extreme fragility.

Preferably, the monobloc body 4 is produced by molding a suitable plastic material, of the type of polyethylene, polyvinyl chloride or the like, or even more preferably polypropylene, the nature of the material being of little consequence to the present invention so long as the support has a sufficient rigidity coupled with limited flexibility of the lateral legs 6 and 7 of the body, as previously mentioned. Under these circumstances, for each tubular element 2 having a given external diameter which is partly nominal, there will correspond an appropriate support, the production mold of this latter permitting imparting to the widths of the space 13 of the recesses 9 and 10 a suitable dimension.

So as to ensure even more effective protection of the tubular element 2 when it is supported by the body 4, there can preferably moreover be provided on each side of the recesses 9 and 10 extensions such as 14 and 15 on the one hand, 16 and 17 on the other hand, respectively disposed on each side of these recesses, extending upwardly from the base 5 as shown in the figures and particularly the cross sectional view of FIG. 3. These extensions thus prolong the lateral legs 6 and 7 upwardly of the body 4, the height being substantially greater than that of the edges 11 and 12 of each of the recesses, so as partially to surround the latter and to prevent direct access to the tubular element 2 in line with these recesses and preventing thus imposing force on the corresponding portions of this latter.

Preferably, the extensions 14 and 15 on the one hand, 16 and 17 on the other hand, extend transversely over a distance very much greater than that of the recesses 9 and 10, by being particularly provided from the longitudinal ends of the body 4 to extend in a direction from one to the other without however meeting in the medial portion of the support.

Thus, and according to a particular characteristic of the device, there is provided in this medial portion a large notch 18 in line with which the inverted U-shape base constituting the body 4 is preferably eliminated, the tubular element 2 being under these circumstances freely suspended between these recesses 9 and 10 passing through the notch 18, as shown more particularly in FIGS. 1 and 2. This notch thus permits the user to grasp delicately the element 2 in line with this latter and, once this element is disengaged from its recesses, to withdraw it quite safely from the support for its intended use.

As will be seen from the preceding, the removal of the tubular element 2 is effected with the greatest simplicity by using the relative elasticity of the material of the body 4 and the U-shape construction of this latter. It thus suffices, for the user who wishes to withdraw the element 2, to exert on the ends of the lateral legs 6 and 7 a slight force to bring them together in the direction of the arrows 8, to give rise simultaneously in the manner comparable to scissors, of a corresponding spacing in the direction of the arrows 19 in FIG. 3, of the extensions 14 and 15 on the one hand, 16 and 17 on the other hand, surrounding the recesses 9 and 10, this movement being accompanied by a limited opening effect of the recesses by concomitant spacing of their edges 11 and 12, such that the element 2, immobilized at the bottom of these recesses and maintained without excessive gripping by these edges, can be withdrawn without any resistance, by the user who grasps it in the notch 18 by its medial portion.

Conversely, when the element 2 is to be replaced in the support, it suffices for the examiner to exert again a slight pressure on the lateral legs 6 and 7 partially to open the recesses 9 and 10 in which the element can be emplaced, before the release of these legs ensures, by the one piece construction, the immobilization and the maintenance of this latter with just the necessary gripping.

There is thus provided a device for the support and protection of a tubular element having a very small diameter, particularly of the micropipette type for medical use, in particular of the type of those used in the in vitro fertilization techniques, such a use naturally having no limiting characteristic as to the possibilities of use and employment of the support in question.

This latter is very simple to use, has very great safety, not only as to the manipulations of the tubular element in its main portion, but more particularly at the level of its drawn out end whose fragility is greatly increased by reason of these dimensions, this support having moreover a particularly limited sales price.

Of course, it follows that the invention is not limited to the embodiment more particularly described above, with respect to the accompanying drawing; it embraces on the contrary all variations within the scope of the accompanying claims.

What is claimed is:

1. A device for the support and protection (1) of elongated elements (2), comprising a monolithic member of a material having elasticity, comprising an elongated body (4) having a cross section substantially in the shape of an inverted U with a central base (5) prolonged by two lateral legs (6, 7) substantially parallel to each other, the base of the U comprising on its surface opposite the legs at least two recesses (9, 10) that open away from the legs in one piece with the elongated body (4), disposed in prolongation of each other and being separated from each other so as to receive said elongated element and to maintain it in at least two said spaced recesses, each of these recesses being delimited by two parallel edges (11, 12) extending from the base of the U, substantially perpendicular to the base and parallel to the longitudinal direction of the body.

2. A device according to claim 1, wherein the material constituting the body (4) of the support is a resilient plastic material.

3. A device according to claim 1, wherein the sides of the base of the U, in line with the lateral legs (6, 7), comprise, facing the recesses (9, 10) and spaced therefrom, extensions (14, 15–16, 17) prolonging said legs to protect the element disposed in the recesses.

4. A device according to claim 3, wherein the height of the extensions is substantially greater than that of the edges (11, 12) of the recesses.

5. A device according to claim 3, wherein the body (4) of the support has in its central region, between the two recesses (9, 10) receiving the element (2), a notch (18) provided in each of said extensions (14, 15–16, 17).

* * * * *